US007550677B2

(12) United States Patent
Debladis et al.

(10) Patent No.: US 7,550,677 B2
(45) Date of Patent: Jun. 23, 2009

(54) ELECTRICAL CONTROL CABLE

(75) Inventors: Francis Debladis, Sainte Catherine les Arras (FR); Jérôme Fournier, Lyons (FR); Olivier Schuepbach, Lignieres (CH); Michel Saurel, Lens (FR)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/986,153

(22) Filed: Nov. 20, 2007

(65) Prior Publication Data

US 2008/0128151 A1 Jun. 5, 2008

(30) Foreign Application Priority Data

Nov. 22, 2006 (FR) ..... 06 55040

(51) Int. Cl.
*H01B 5/00* (2006.01)

(52) U.S. Cl. ..... 174/128.1; 174/126.2

(58) Field of Classification Search ..... 174/110 R, 174/113 R, 102 R, 108, 36
See application file for complete search history.

(56) References Cited

U.S. PATENT DOCUMENTS

| | | | | | |
|---|---|---|---|---|---|
| 4,449,012 | A * | 5/1984 | Voser | 174/70 A |
| 5,313,020 | A * | 5/1994 | Sackett | 174/113 C |
| 5,570,537 | A * | 11/1996 | Black et al. | 43/112 |
| 5,808,239 | A * | 9/1998 | Olsson | 174/113 C |
| 6,388,188 | B1 * | 5/2002 | Harrison | 174/27 |

OTHER PUBLICATIONS

French International Search Report- Jun. 20, 2007.

* cited by examiner

*Primary Examiner*—William H Mayo, III
(74) *Attorney, Agent, or Firm*—Sofer & Haroun, LLP

(57) ABSTRACT

An electrical cable with a section diameter at most equal to 2 mm includes a plurality of strands extending in the longitudinal direction of the cable. The strands are twisted to form a stranded conductor. Only certain strands of the stranded conductor are of electrically conductive material, for example copper, the remaining strands are of non-conductive material, such as polyamide, high strength polyester or a polyetherimide.

12 Claims, 1 Drawing Sheet

ELECTRICAL CONTROL CABLE

RELATED APPLICATION

This application claims the benefit of priority from French Patent Application No. 06 55040, filed on Nov. 22, 2006, the entirety of which is incorporated by reference.

BACKGROUND OF THE INVENTION

1. Field of the Invention

The present invention relates to electrical control cables, or power cables, used to transmit currents.

2. Description of the Prior Art

Such cables are used in various fields of industry, such as the automotive industry, for example, where they are assembled into harnesses for electrical power supply and/or electrical control of various equipments. These cables must therefore in particular be as light as possible and have a small overall size whilst preserving good mechanical strength.

Such cables are conventionally formed by a plurality of copper strands, generally twisted to form a stranded conductor, so as to increase the flexibility of the cable, and surrounded by an insulative sheath, obtained by extrusion, for example. FIG. 1 shows one example of such a cable 1, seen in cross section, produced from seven identical copper strands 20 surrounded by a circular section insulative sheath 30. To give a rough idea, the diameter of the cable is typically of the order of 1.6 mm and the copper strands 20 each have a diameter of the order of 0.3 mm.

The advantages of a cable with the above structure lie essentially in the simplicity of the fabrication process, but also in the fact that it enables reliable crimping of connectors. In fact, it suffices to strip the cable locally by removing a portion of the insulative sheath 30 at the place where the connector is to be located, and then to compress mechanically a bush of the connector around the stripped cable section.

On the other hand, it has been realized that the above cable uses an excessive quantity of copper compared to the real requirements corresponding to the quantity of current to be transmitted by the cable. To be more precise, close to half the copper in the above cable structure is used to increase the tensile strength of the cable, and also to guarantee effective crimping.

Now, copper is costing more and more and it is important to find new cable structures that reduce as much as possible the quantity of copper used.

Various composite cable solutions are known already in which copper strands are combined with a non-conductive material core.

The major drawback of these various composite cable solutions lies in the fact that they all necessitate a fabrication process that is specific to them, with fabrication of dedicated tools for implementing the method. Thus the use of a smaller quantity of copper, which should decrease the cost of the cable, leads in the end to an increase in cost in terms of the fabrication process.

The object of the present invention is to propose a new power cable or electrical control cable structure of compact overall size, low weight and good mechanical strength, which can be fabricated with the same tools as a cable according to FIG. 1.

SUMMARY OF THE INVENTION

Thus the present invention consists in an electrical control cable with a section diameter at most equal to 2 mm, of the type including a plurality of strands extending in the longitudinal direction of the cable, said strands being twisted to form a stranded conductor, characterized in that only certain strands of the stranded conductor are of electrically conductive material, the remaining strands being of a non-conductive material.

All the electrically conductive material strands are preferably identical to each other and all the non-conductive material strands are preferably identical to each other.

The electrically conductive material strands on the one hand and the non-conductive material strands on the other hand can nevertheless have a different section size.

The electrically conductive material strands are advantageously arranged in the stranded conductor so as to be in contact with each other over all their length and at least one of the electrically conductive material strands is advantageously arranged in the stranded conductor to have a portion accessible from the outside of the stranded conductor over the whole of its length.

The non-conductive material preferably has a strain to fracture greater than 10%.

The non-conductive material can be a polyamide.

Alternatively, the non-conductive material is a high-strength polyester or a polyetherimide.

The electrically conductive material can be copper.

The non-conductive material strands can be multistrand structures.

The invention and its advantages will be better understood in the light of the following description, given with reference to the appended drawings.

DETAILED DESCRIPTION OF A PREFERRED EMBODIMENT

By way of a preliminary remark, it should be noted that the appended drawings are not to scale, but nevertheless enable comparison of various cables all having the same outside diameter, typically of the order of 1.6 mm. For an electrical control cable according to the invention, the section could have a different diameter, at most equal to 2 mm. Moreover, all the cables represented have, by way of nonlimiting example, a circular section. Of course, other shapes could be envisaged without departing from the scope of the present invention.

Figure 1:
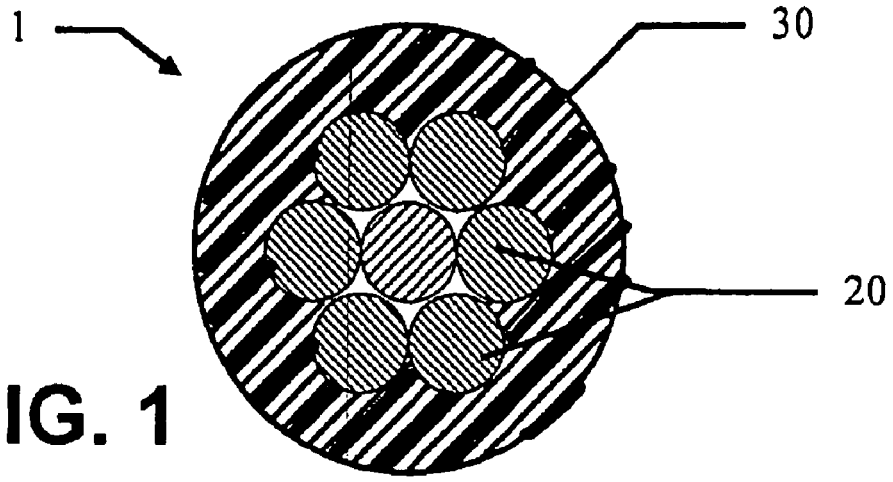
FIG. 1 PRIOR ART
FIG. 1, already described hereinabove, represents a cross section of a prior art power cable.
Figure 2:
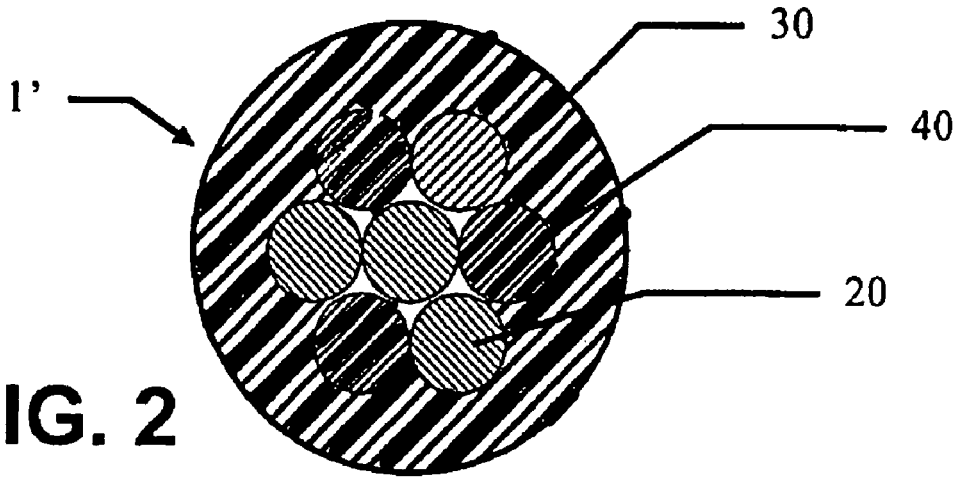
FIG. 2 illustrates diagrammatically one possible embodiment of a cable according to the invention, also seen in cross section.

According to FIG. 2, a control cable 1' according to one possible embodiment of the invention differs from the FIG. 1 control cable 1 in that certain of the strands of copper (or other electrically conductive material, such as copper-plated aluminum, which is a more economical and lighter material than copper) forming the stranded conductor have been replaced by strands 40 of a non-conductive material. In the FIG. 2 example, three of the copper strands have been replaced by strands 40 of non-conductive material.

Just like the cable from FIG. 1, the cable 1' further includes an insulative sheath 30 surrounding the stranded conductor the length of the cable.

Thus the fabrication method used to fabricate the cable 1' and the associated tools are in all respects identical to those used for the fabrication of a cable 1.

All the strands of the same kind must be identical. In the case of FIG. 2, all the strands also have a section of identical size, typically of the order of 0.3 mm.

Nevertheless, there may equally be provision for the use of strands 40 of different section, in particular of smaller size, to the section of the strands 20. A smaller overall section is obtained in this way, for equal performance.

The number and the section of the electrically conductive material strands 20 are chosen to obtain a minimum resistance per unit length of the cable, typically less than 100 ohm/km.

The number and the section of the non-conductive material strands 40 are chosen to confer the required mechanical strength on the cable.

These choices obviously depend also on the non-conductive material used. This can be a polyamide. Alternatively, and preferably, high-strength polyester is used, or polyetherimide, which offer good strength at raised temperature.

The material used for the non-conductive strands will preferably be selected in a range of materials having a strain to fracture greater than 10%. Accordingly, regardless of the location of the strands 40 within the cable, the latter will have a very high tensile strength and resistance to bending.

The arrangement of the various strands 20 in the stranded conductor should preferably be chosen to guarantee reliable crimping for connecting the cable. This object is achieved by providing for at least one of the electrically conductive material strands 20 to have a portion accessible from the exterior of the stranded conductor over the whole of its length. In the FIG. 2 embodiment, three of the copper strands 20 have this feature. Thus by stripping the cable 1' locally, there is immediate access to an electrically conductive strand.

Moreover, the arrangement of the various strands 20 in the stranded conductor should preferably guarantee that the cable is operative even if one of the strands 20 were to be cut. This object is achieved by providing for all the strands 20 to be in contact with each other over the whole of their length.

Thanks to the invention, the cost of the cable obtained is greatly reduced because of the reduction in the quantity of copper used.

There is claimed:

1. An electrical control cable with a section diameter at most equal to 2 mm comprising:

a plurality of strands extending in the longitudinal direction of said cable, said strands being twisted to form a stranded conductor, wherein only certain strands of said stranded conductor are of electrically conductive material, the remaining strands being of a non-conductive material.

2. Cable according to claim 1, wherein the diameter of the section of said cable is substantially of the order of 1.6 mm.

3. Cable according to claim 1, wherein all said electrically conductive material strands are identical to each other and all said non-conductive material strands are identical to each other.

4. Cable according to claim 3, wherein said electrically conductive material strands and said non-conductive material strands have a different section size.

5. Cable according to claim 1, wherein said electrically conductive material strands are arranged in said stranded conductor so as to be in contact with each other over the whole of their length.

6. Cable according to claim 5, wherein at least one of said electrically conductive material strands is arranged in said stranded conductor to have a portion accessible from the outside of said stranded conductor over the whole of its length.

7. Cable according to claim 1, wherein said stranded conductor is formed of seven strands, of which three are of non-conductive material.

8. Cable according to claim 1, further including an insulative sheath surrounding said stranded conductor the length of said cable.

9. Cable according to claim 1, wherein said non-conductive material has a strain to fracture greater than 10%.

10. Cable according to claim 1, wherein said non-conductive material is a polyamide.

11. Cable according to claim 1, wherein said non-conductive material is a high-strength polyester.

12. Cable according to claim 1, wherein said electrically conductive material is copper.

* * * * *